US008157091B2

(12) United States Patent
Gabbard

(10) Patent No.: US 8,157,091 B2
(45) Date of Patent: Apr. 17, 2012

(54) PAINT BRUSH PROTECTIVE COVER

(76) Inventor: Barry Todd Gabbard, Vandalia, OH (US)

( * ) Notice: Subject to any disclaimer, the term of this patent is extended or adjusted under 35 U.S.C. 154(b) by 35 days.

(21) Appl. No.: 12/832,749

(22) Filed: Jul. 8, 2010

(65) Prior Publication Data

US 2010/0276318 A1 Nov. 4, 2010

Related U.S. Application Data

(63) Continuation-in-part of application No. 12/390,095, filed on Feb. 20, 2009, now abandoned.

(51) Int. Cl.
*A45D 44/18* (2006.01)

(52) U.S. Cl. ..... 206/362.4; 206/361; 206/15.3; 206/459.5

(58) Field of Classification Search ..... 206/15.3, 206/362.4, 362.3, 361, 470, 459.5; 220/4.22, 220/4.23, 4.24, 736, 837
See application file for complete search history.

(56) References Cited

U.S. PATENT DOCUMENTS

| | | | | | |
|---|---|---|---|---|---|
| 4,423,811 | A * | 1/1984 | Knapp | 206/362.3 |
| 4,784,264 | A * | 11/1988 | Sykes | 206/387.13 |
| 5,090,568 | A * | 2/1992 | Tse | 206/456 |
| 5,121,834 | A * | 6/1992 | Tissembaum | 206/38.1 |
| 5,244,090 | A | 9/1993 | Keith | |
| 5,465,453 | A | 11/1995 | Landmeir | |
| 5,645,164 | A * | 7/1997 | Hocking | 206/209 |
| 5,645,167 | A | 7/1997 | Conrad | |
| D401,765 | S * | 12/1998 | Soutullo | D4/199 |
| 6,199,694 | B1 * | 3/2001 | Van Diest et al. | 206/361 |
| 6,338,406 | B1 * | 1/2002 | Zagar | 206/362.2 |
| 6,575,295 | B2 | 6/2003 | Mayfield | |
| 7,007,797 | B1 | 3/2006 | Ruccolo | |
| 7,987,980 | B1 * | 8/2011 | Hahn | 206/361 |
| 2003/0062280 | A1 | 4/2003 | Davis | |
| 2003/0135945 | A1 * | 7/2003 | Nordstrom | 15/168 |
| 2004/0050732 | A1 | 3/2004 | Baker | |
| 2007/0012710 | A1 * | 1/2007 | Vovan | 220/793 |

* cited by examiner

*Primary Examiner* — David Fidei
(74) *Attorney, Agent, or Firm* — R. William Graham

(57) ABSTRACT

A paint brush protective cover for a paint brush includes a jacket which provides for wet media storage and safe transportation.

16 Claims, 10 Drawing Sheets

Detail 'A'

Detail 'B'

PAINT BRUSH PROTECTIVE COVER

This is a continuation-in-part of U.S. application Ser. No. 12/390,095 filed Feb. 20, 2009 now abandoned and claims the benefit thereof.

BACKGROUND OF THE INVENTION

1. Field of the Invention

This invention relates to paint brushes and, more particularly, to a paint brush protective cover that protects the bristles of paint brushes from being damaged during wet or dry storage or nonuse thereby extending the life of the paint brush.

2. Related Art

In cases where a purchaser opts to purchase a paint brush to perform a painting job, there is a choice of brush shape, size and different filament materials. A professional painter can own many brushes, each with its own use. Typically each project can require several brushes, for large areas a 3 or 4 inch is used for general cutting in large pieces or general use whereas and for trim a 1½ inch works well. On a professional site there may be a crew of painters each using several brushes.

Fine paint brushes are expensive however they are required for a professional job as they apply a smoother finish with less brush strokes and paint faster and with less effort. If properly cleaned and stored they will last for years and conversely if not will have a short life. Inexpensive paint brushes can shed bristles into the finish and are difficult to work with, producing an inferior finish.

Paint brushes are categorized according to the type of coating being applied; water based paints and primers, such as latex or acrylic paints and primer plus water based epoxy; oil based paints and primers, such as alkyd paints and primers plus oil based epoxies; solvent thinned paints and primers; water based clear wood finishes and stains, such as acrylic urethane, water based polyurethane and its variants plus water based wood stains; oil based clear wood finishes and stains; this includes the common varnish and polyurethane plus oil based wood stains; all solvent thinned clear finishes and wood stains; shellac primers and clear finishes, such as tinted and clear shellac is thinned with denatured alcohol.

Each of these "types" of coatings or stains has a specific type of brush that is used. Type of paint brush refers to the filaments used in its construction. These filaments can be synthetic, natural, or a combination of the two. Synthetic refers to different types of plastics used to make the filaments, nylon and polyester or blends of the two. Natural refers to animal hair that is used in the brushes construction, this type of filaments are called bristles. Filaments are designed for specific solvents and will be damaged if used in the wrong solvent or improperly stored.

Synthetic brushes loose there shape in oil base paints and primers, an oil paint brush must be stiff enough to hold its shape and soft enough not to leave to many brush marks. Brush manufactures use a blend of different natural bristles to change the softness and stiffness for performing s job, for example, one having the stiffness for cutting in a straight line and thicker hair for holding more paint or one suited for varnishes, polyurethane and stains or one's for clear wood finishes require a very soft brush for the best results.

Bristle brushes cannot be used with latex paints or be cleaned with water this will ruin the brush. Natural bristle paint brushes absorb water and loose their shape, becoming impossible to control. However, cleaning the brush after every use is not desirable as it takes time and use of costly solvents.

It is desirable to leave the brush wet. Some painters leave the brush in a zip lock bag or in a bucket of paint. While this prevents cleanup, it often results in the disfigurement of the bristles. This is particularly problematic with cut-in brushes which come in a variety of shapes such as angular, flat, and oval, and size ranges from 1-6 inches wide and if disfigured become useless.

Fine paint brushes typically are expensive. User's of fine paint brushes, such as professionals, require excellent coverage from their paint brush, durability from their paint brush, greater efficiency in production, precise lines, proven results for smooth finishes and a lack of bristles or filaments left behind from the paint brush. When a paint brush no longer is capable of producing, the paint brush will be discarded and a new paint brush is purchased to replace the old paint brush.

After a job is finished, the brush must be cleaned in an appropriate solution to remove all of the remaining paint. Sometimes the bristles tend to separate and fray off in non-uniform directions and become a problem for the next usage so care must be taken to store the brush in a manner wherein the bristles can be maintained aligned.

Covers that the paint brushes typically come with are made of paper and are rather flimsy and easily tear and do not last very long. If no protective cover is used, in addition to the above described disfigurement occurring, dust and other particles generally stick and become imbedded inside the bristles. These particles will collect on the paint producing non-uniform streaks of paint during use.

Prior attempts to cover paint brushes include conventional paper or plastic covers which substantially fold about the bristles to maintain the filament shape. Some cases provide for air holes so that the filaments can dry after cleaning is performed.

The problem which is not addressed is that of wet media storage. Painters need a simple and easy cover for both dry and wet storage of the brushes which protects the filaments. There is also a need for quick, safe and easy transportation of brushes. Therefore, a need exists to provide an improved paint brush protective cover. The improved paint brush cover must be simple to use, allow for wet and dry storage, easy cleanup and durability and be inexpensive.

SUMMARY OF THE INVENTION

It is an object to improve paint brush covers.

It is a further object to provide a wet/dry paint brush cover.

It is another object to provide an improved paint brush protective cover that is simple to use.

Yet another object is to provide an improved paint brush protective cover that is durable.

It is another object to provide an improved paint brush protective cover that is inexpensive.

Still another object is to provide safe and easy transport of a paint brush.

A further object is to provide a user with a productivity guide for the brush.

Another object is to enable storage of a brush in wet media.

Accordingly, one embodiment of the invention is directed to a paint brush protective cover for protecting bristles of a paint brush. The paint brush protective cover includes a jacket having a hollow interior section, wherein the jacket has a first panel having lateral connecting surfaces and a second panel having lateral connecting surfaces configured to receive the lateral connecting surfaces of the first panel in a manner to removably connect the first panel and the second panel in a manner to be maintained in a predetermined spaced relation to receive the paint brush therebetween, wherein each panel has an upper end and a lower end and are configured to be complementary connected in a manner with the upper ends adjacent one another and the lower ends adjacent one another, preferably via a living hinge, wherein the jacket is of a length greater than a combined length of filaments and at least the collar and the upper ends are configured to retain about the collar and the lower ends are configured to retain about the filaments, and wherein the jacket includes at least one lower opening adjacent a terminal part of the lower ends to readily permit drainage from the jacket by virtue of gravity when upper ends are further displaced from a gravitational surface than the lower ends; and wherein each of the panel includes at least one panel opening which extends lengthwise from each the upper end into the lower end terminating at a predetermined distance from a lower end edge and is defined by top edge, bottom edge and side edges.

Another embodiment is directed to a paint brush protective cover for a paint brush having filaments, a collar or ferrule retaining the filaments, which includes a jacket having a hollow interior section, wherein the jacket has a first panel and a second panel removably connectable to the first panel in a manner to be maintained in a predetermined spaced relation to receive the paint brush therebetween, wherein each the panel has an upper end and a lower end and are configured to be complementary connected in a manner with the upper ends adjacent one another and the lower ends adjacent one another, preferably by living hinge, wherein the jacket is of a length greater than a combined length of filaments and at least the collar and the upper ends are configured to retain about the collar and the lower ends are configured to retain about the filaments, and wherein the jacket includes at least one lower opening adjacent a terminal part of the lower ends to readily permit drainage from the jacket by virtue of gravity when upper ends are further displaced from a gravitational surface than the lower ends; and wherein each panel includes at least one panel opening which extends lengthwise from each the upper end into the lower end terminating at a predetermined distance from a lower end edge and is defined by top edge, bottom edge and side edges, and at least one productivity guide and wear bar which extends transversely through the panel opening and interconnecting the side edges to retain filaments of the brush and serves as a visual productivity guide and wear indicator for filament length.

Still another embodiment is directed to a paint brush protective cover for a paint brush having filaments, a collar retaining the filaments and handle, which includes a jacket having a hollow interior section, wherein the jacket has a first panel having lateral connecting surfaces and a second panel having lateral connecting surfaces configured to receive the lateral connecting surfaces of the first panel in a manner to removably connect the first panel and the second panel in a manner to be maintained in a predetermined spaced relation to receive the paint brush therebetween, wherein each the panel has an upper end and a lower end and are configured to be complementary connected in a manner with the upper ends adjacent one another and the lower ends adjacent one another, wherein the jacket is of a length greater than a combined length of filaments and at least the collar and the upper ends are configured to retain about the collar and the lower ends are configured to retain about the filaments, and wherein the jacket includes at least one lower opening adjacent a terminal part of the lower ends to readily permit drainage from the jacket by virtue of gravity when upper ends are further displaced from a gravitational surface than the lower ends; and wherein each panel includes at least one panel opening which extends lengthwise from each the upper end into the lower end terminating at a predetermined distance from a lower end edge and is defined by top edge, bottom edge and side edges, and at least one productivity guide and wear bar which extends transversely through the panel opening and interconnecting the side edges to retain filaments of the brush and serves as a visual productivity and wear indicator for filament length. The lower openings on the jacket allow fluid such as paint and solvent to drain adequately and the openings allow air to circulate within the protective cover and about the filaments of the brush.

The invention provides a protective measure for the filaments as well as productivity guide and wear indicator of for the filaments. This deters the filaments from becoming disfigured. Also, the productivity guide and wear bar aids in showing the amount of usage left on the brush.

A handle opening is formed in end surface of the jacket adjacent the upper ends of the panels allowing the handle of the paint brush to protrude out of the jacket. The handle opening is formed between laterally extending connecting surfaces of each of the first and second panels which provide connection of the panels as well as the panels all of which serve to retain about the handle. The first panel's lateral connecting surfaces can be configured to be received inside of the second panel's lateral connecting surfaces and can include a detent surface or other friction fit surface to maintain connection therebetween. A laterally extending tab can be provided on the first panel to aid in separating the panels once connected.

The foregoing and other objects, features, and advantages of the invention will be apparent from the following, more particular, and description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
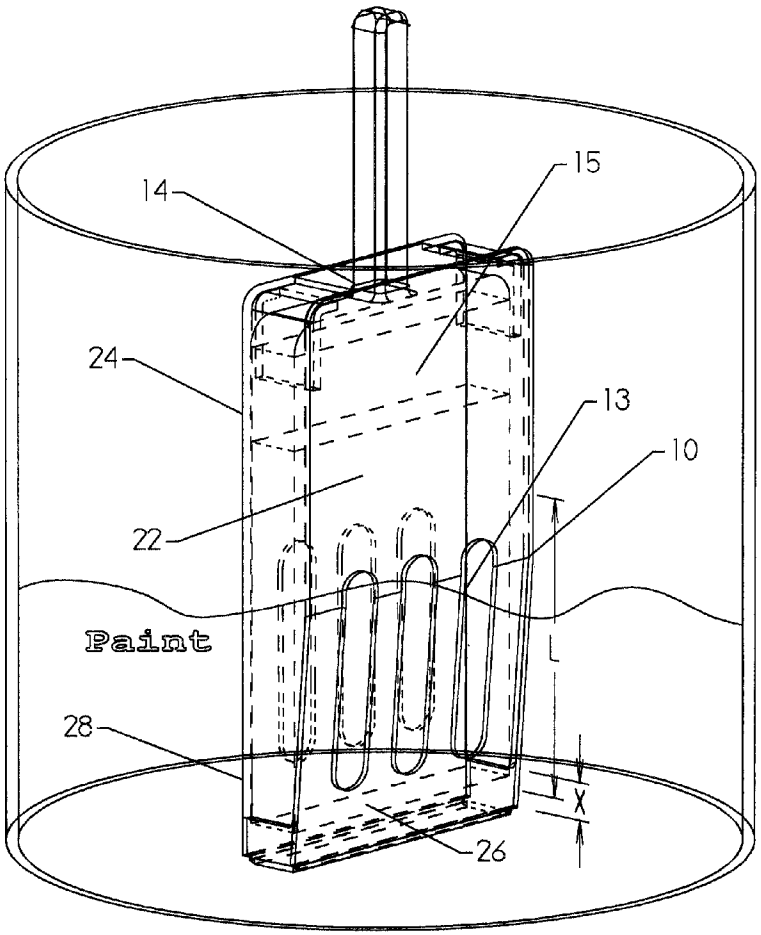
FIG. 1 is an elevated perspective view of the paint brush protective cover of the present invention in a closed position covering the bristles of a paint brush disposed within a paint container with wet media (paint) therein for wet media storage.
Figure 2:
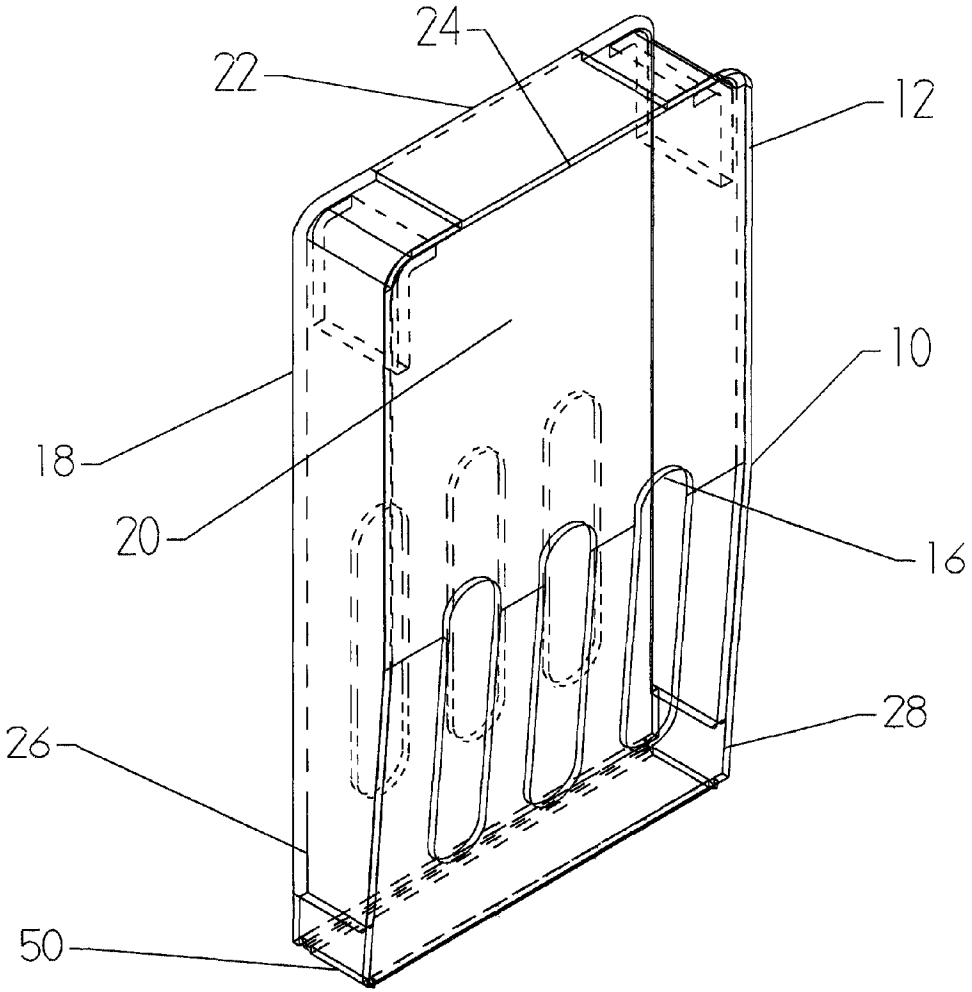
FIG. 2 is an elevated perspective view of the paint brush protective cover of the present invention in a closed position.
Figure 3:
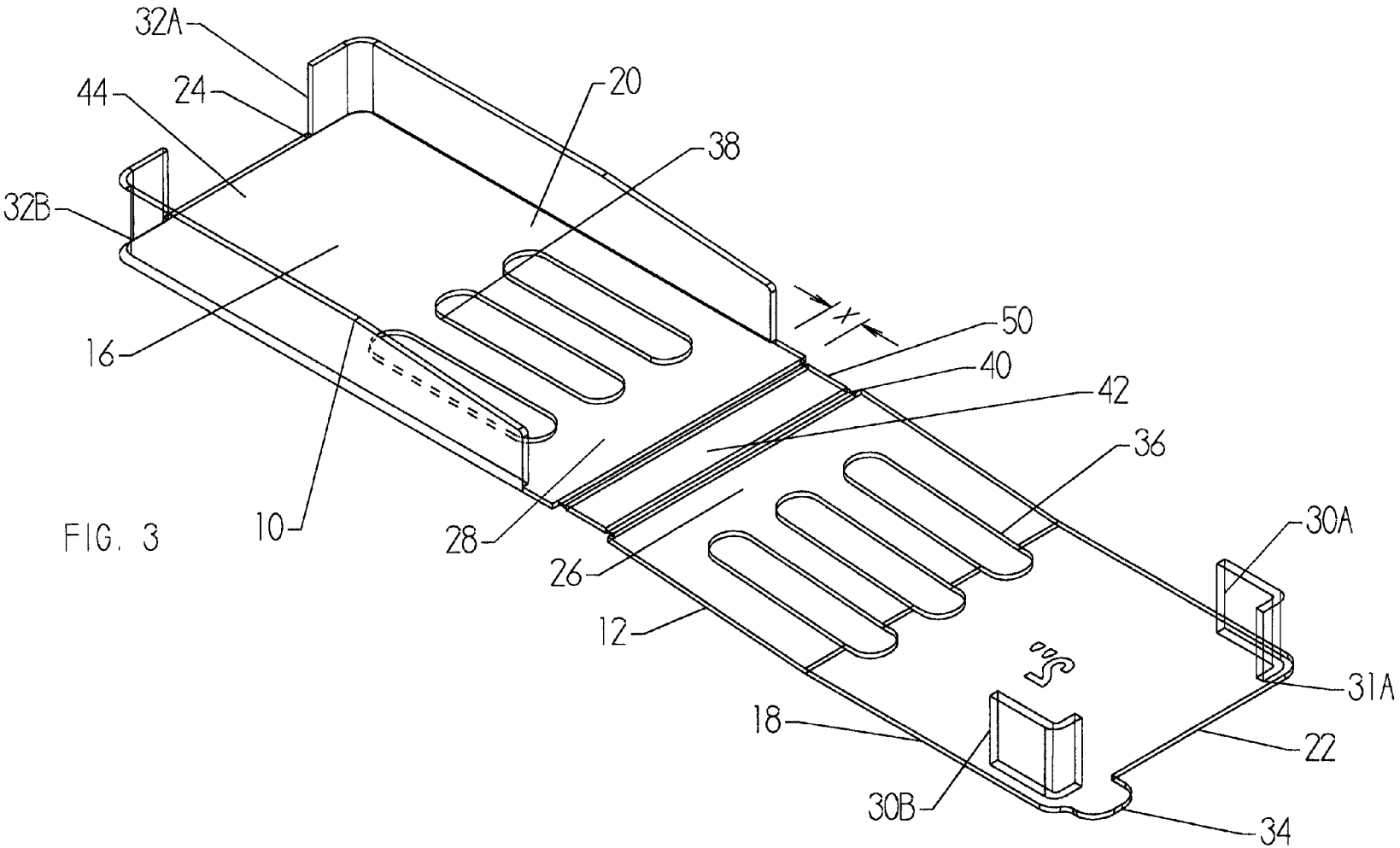
FIG. 3 is a perspective view of the paint brush protective cover of the present invention in an open position showing an interior thereof.
Figure 4:
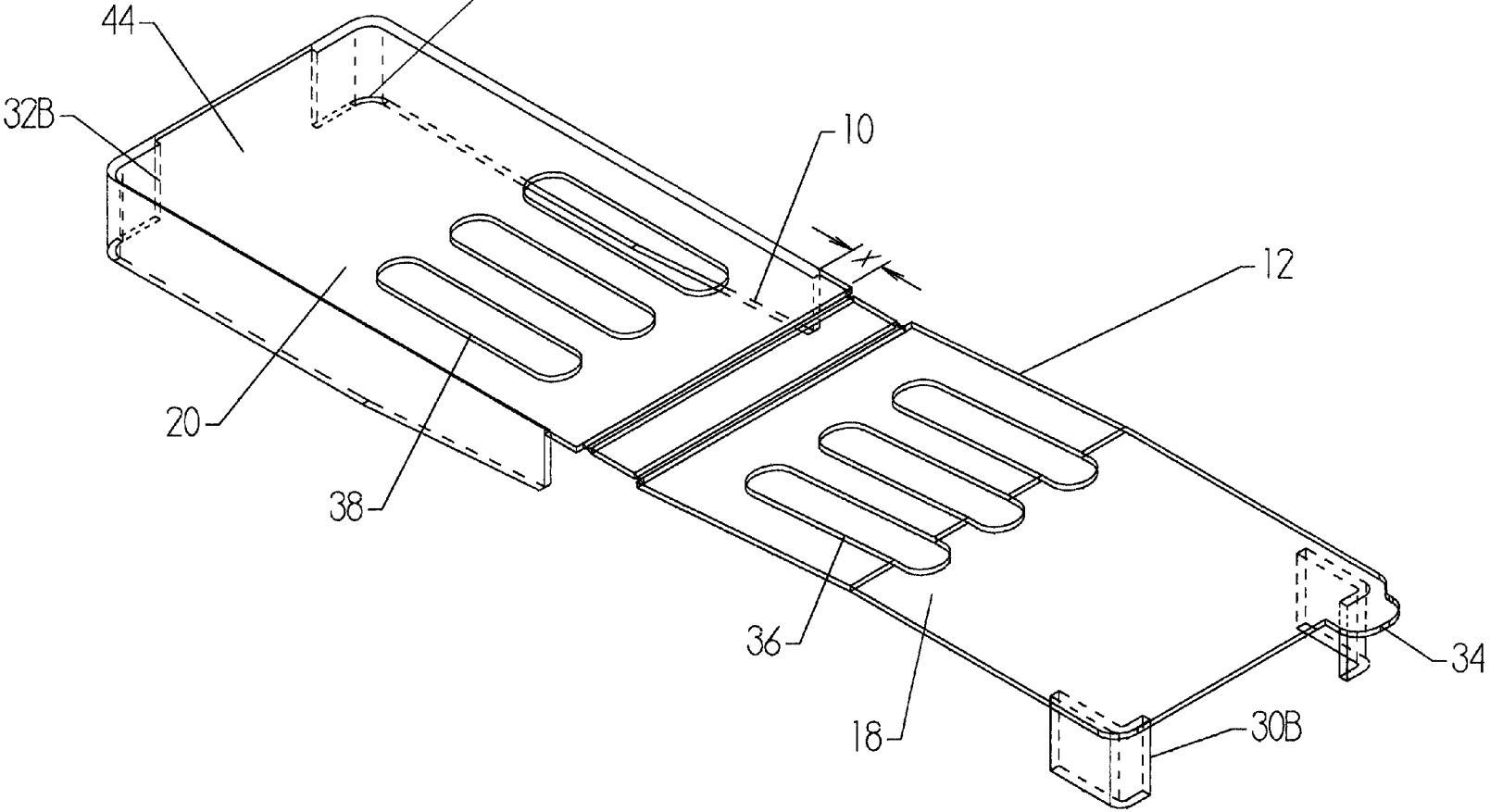
FIG. 4 is a perspective view of the paint brush protective cover of the present invention in an open position showing an exterior thereof.
Figure 5:
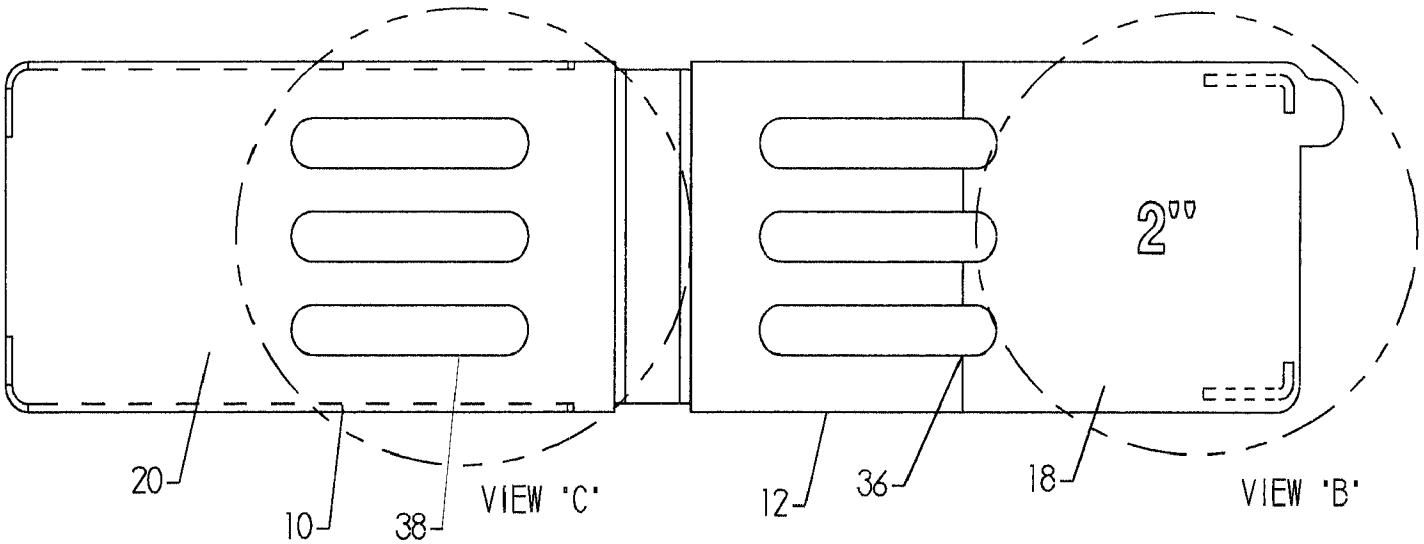
FIG. 5 is a back outside plan view of the paint brush protective cover of the present invention in an open position.
Figure 6:
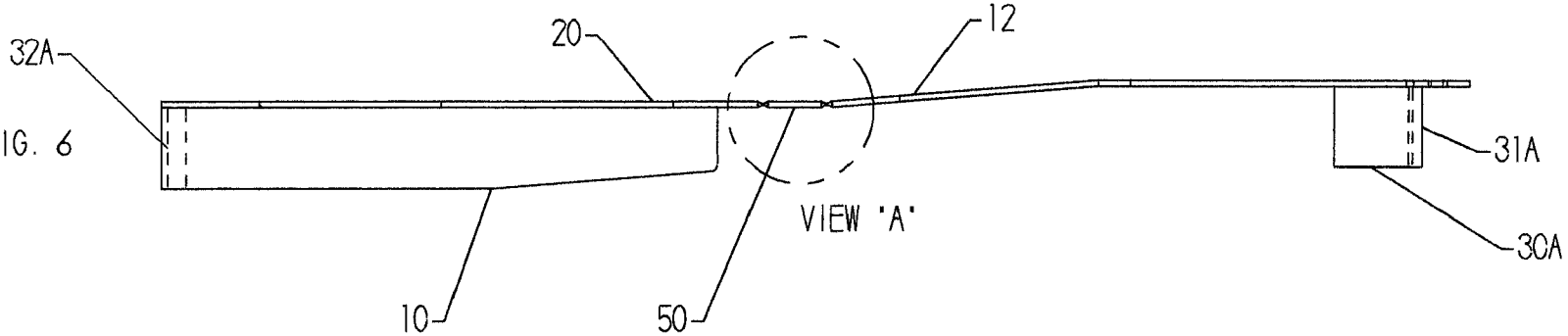
FIG. 6 is a side view of the paint brush protective cover of the present invention in an open position.
Figure 7:
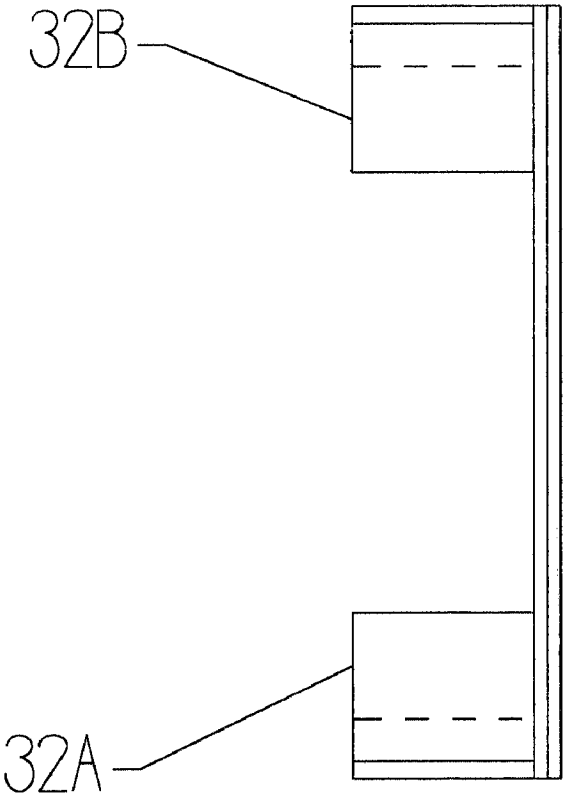
FIG. 7 is an end view of the paint brush protective cover of the present invention in an open position.
Figure 8:
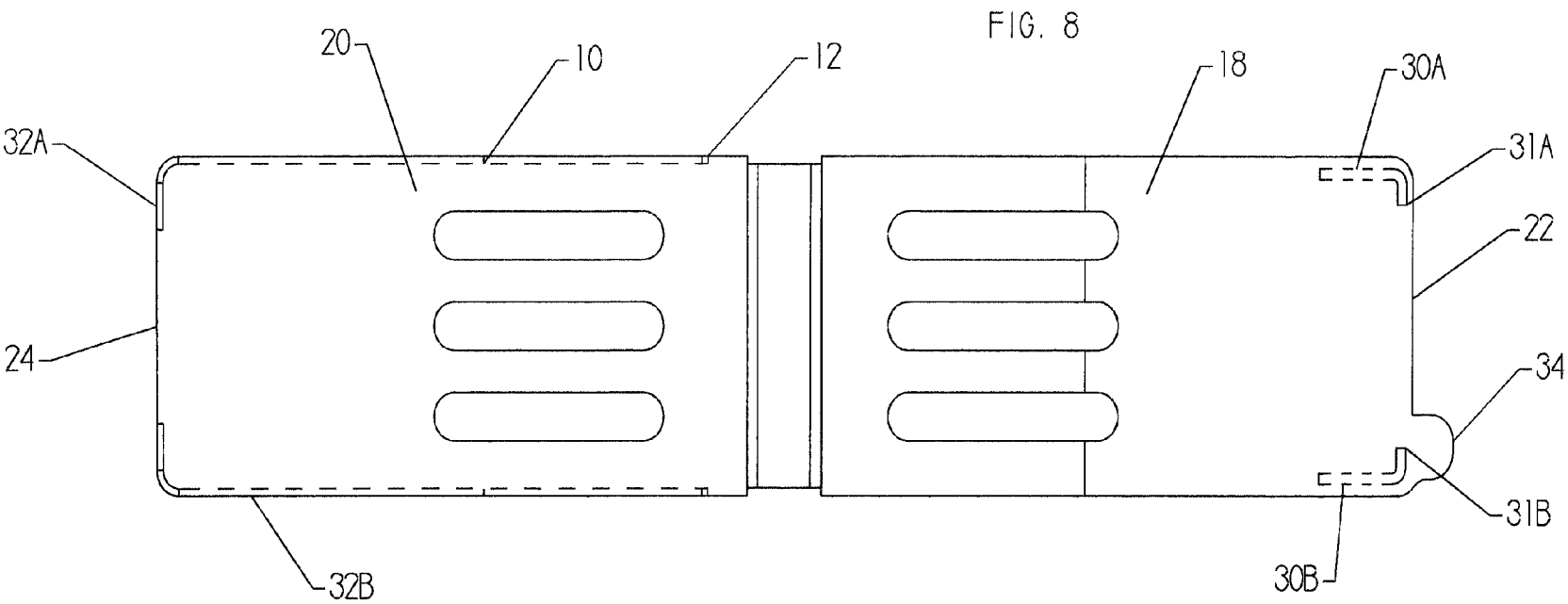
FIG. 8 is a front inside plan view of the paint brush protective cover of the present invention in an open position.
Figure 9:
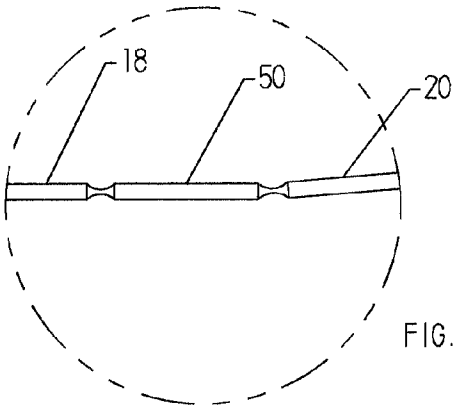
FIG. 9 is an enlarged view of a living hinge portion of FIG. 6.
Figure 10:
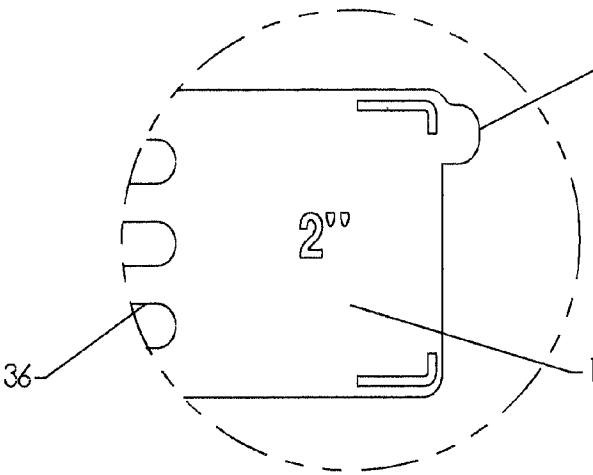
FIG. 10 is an enlarged view of a portion of FIG. 5.
Figure 11:
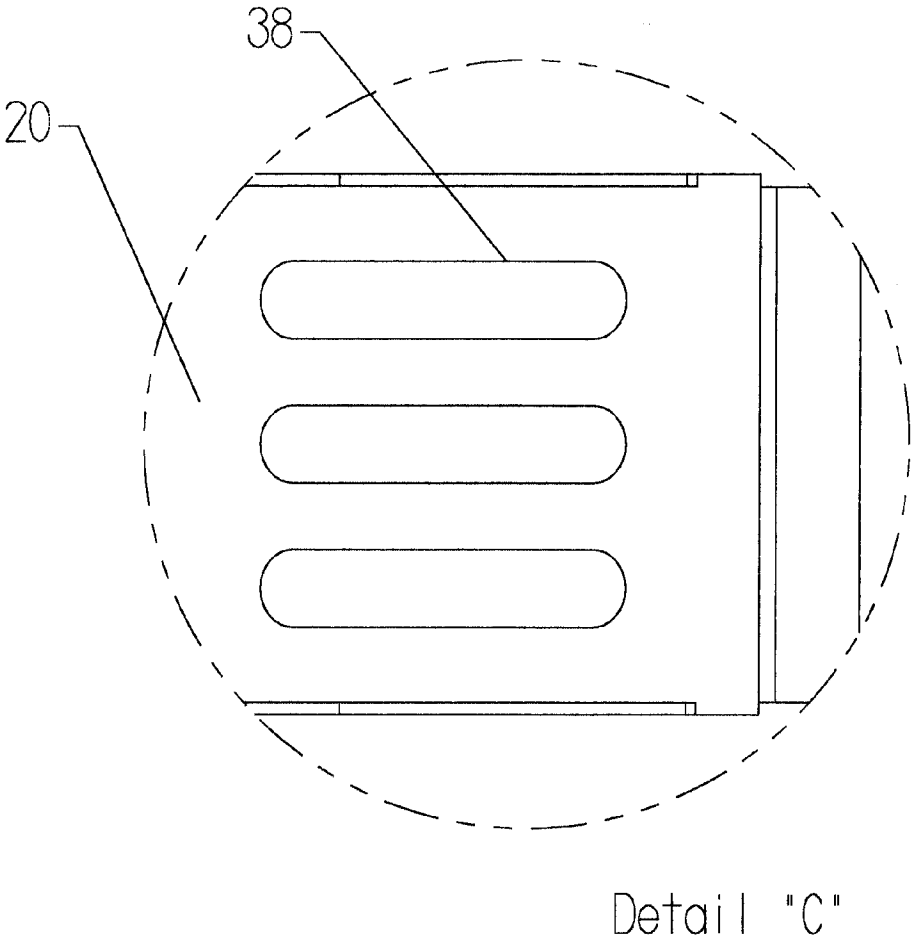
FIG. 11 is an enlarged view of another portion of FIG. 5.
Figures 12, 13, 14:
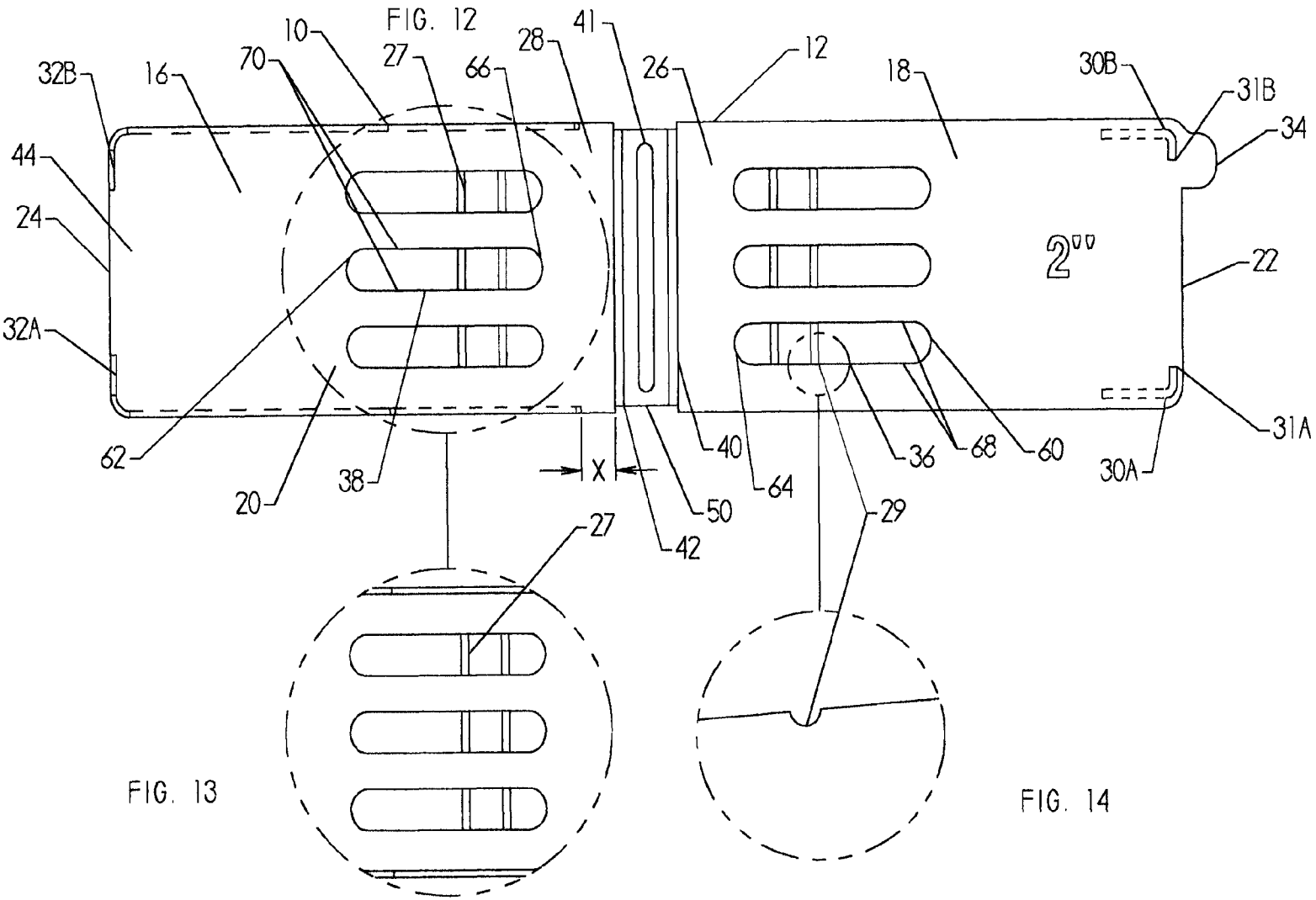
FIG. 12 is a plan view of an embodiment of the invention.
FIG. 13 is an enlarged view of a portion of FIG. 12.
FIG. 14 is an enlarged view of another portion of FIG. 12 through line 14-14.

Referring now to the drawings, a paint brush protective cover is generally designated by the numeral 10. The paint brush protective cover 10 includes a single jacket 12 made from an anti-stick polymer plastic, such as polystyrene, so that paint will not readily adhere to the jacket 12. This will aid in the wet storage aspect of the invention.

The jacket 12 can be rectangular in shape and it is contemplated that the jacket 12 can be configured with various shapes and sizes so long as the objectives of the invention can be maintained. The jacket 12 should be sufficient enough size to contain a lower end 13 of the paint brush 14 and at least part of an upper end 15 of the paint brush 14. By way of example, the jacket 12 is configured for a 2" brush 14.

The jacket 12 has a hollow interior section 16 which is defined by a first panel 18 and a second panel 20 of the jacket 12 which are removably connectable to one another in a manner to be maintained in a predetermined spaced relation. Each panel 18 and 20 has an upper end 22 and 24, respectively, and a lower end 26 and 28, respectively, which are configured to be complementary connected in a manner with the upper ends 22 and 24 adjacent one another and the lower ends 26 and 28 adjacent one another.

The first panel 18 includes lateral connecting surfaces 30A and 30B and can be configured to be received inside of the second panel's lateral connecting surfaces 32A and 32B. By way of example, lateral connecting surfaces 30A and 30B can include detent surfaces 31A and 31B or other friction fit surface to improve connection with connecting surfaces 32A and 32B. A laterally extending tab 34 can be provided on the first panel 18 to aid in separating the panels 18 and 20 once connected.

The jacket panels 18 and 20 are of a length greater than a combined length of filaments and at least a collar part of the paint brush retaining the filaments and preferably a greater than a combined length of filaments (herein referred to as lower end 13 of the brush 14), and collar part of the paint brush retaining the filaments and part of the handle (herein referred to as upper part 15 of the brush 14).

Upper ends 22 and 24 are configured to retain about the upper part 15 of the brush 14 and lower ends 26 and 26 are configured to retain about lower end 13 of the brush 15. Each panel 18 and 20 can include a plurality of laterally spaced elongated openings 36 and 38, respectively, which extend from respective upper ends 22 and 24, respectively, and into the lower ends 26 and 28, respectively, terminating at a predetermined distance "X" short of an edge 40 and 42 of each panel 18 and 20, respectively. In this regard, it is important to note that the openings 36 and 38 can preferably not extend to a point beyond the length "L" of the filaments of the brush when stored within the jacket as this could permit the filaments to become disfigured by protruding outside of the openings 36 or 38.

Productivity guide and wear bars 27 and 29 are provided. Openings 36 and 38 extend lengthwise from each the respective upper ends 22 and 24 into the lower ends 26 and 28 respectively terminating at a predetermined distance from a lower end edge 40 and 42, respectively, and are defined by top edge 60 and 62, bottom edge 64 and 66 and side edges 68 and 70 respectively. Productivity guide and wear bars 27 and 29 extend transversely through the panel openings 36 and 38, respectively, and interconnect the side edges to retain filaments of the brush and serves as a visual productivity guide and wear indicator for filament length.

The productivity guide and wear bars 27 and 29 aid in retaining the filaments 13 of the brush 14. The productivity guide and wear bars 27 and 29 can preferably include a curved rib cross section which aid in guiding the filaments 13, broken and unbroken, into the jacket 12. The productivity guide and wear bars 27 and 29 provide a good visual indication of the productivity remaining of the brush 14 and aid in retaining filaments 13 within the jacket 12.

Accordingly, each lower end 26 and 28 of each panel 18 and 20, respectively, there remains a continuous transverse section to retain the filaments and into which the openings 36 and 38 do not extend. The plurality of openings 36 and 38 are thus located on the jacket 12 for allowing fluid such as paint, solvent, or air to circulate within the protective cover and about the filaments of the brush 14.

A handle opening 44 is formed in end surface 23 of the jacket 12 adjacent the upper ends 22 and 24 of the panels 18 and 20 allowing the handle H of the paint brush to protrude out of the jacket 12. The handle opening 44 is formed between laterally extending connecting surfaces 30A, 30B and 32A, 32B and ends 22 and 24 of each of the first and second panels 18 and 20 all of which serve to retain about the handle H. Sides 32A and 32 B do not extend the panel 20 to permit flow of paint out of the end of the jacket 12 when closed.

One may open the jacket 12 to expose a hollow interior section 16. The interior section 16 is where the bristles of the paint brush 14 will be stored in wet or dry manner. The first panel 18 is connected together the second panel by a junction panel 50 and is characterized as a living hinge which is a special type of connector style that is bent while the plastic piece is still warm right out of the mold. Junction panel 50 includes a lower opening 41 to readily permit drainage. Opening the jacket 12 will expose the hollow interior section 16 enabling positioning the paint brush 14 within the jacket 12 and when closed protect the bristle or filament 13 configuration of the brush 14.

The openings 36 and 38 provide for retention of the bristles while being stored in paint in the case of the jacket 12 being submerged into paint with the brush 14 therein as seen in FIG. 1. Upon removal, these openings 36 and 38 provide for quick drainage of paint from the jacket 12 so that the jacket 12 can be readily opened without causing a paint spill. After removal of the brush 14 from the jacket 12, any remaining paint on the jacket 12 should easily drip off. After a job, the brush 14 is cleaned and disposed back in the jacket 12 where the openings 36 and 38 will allow air to circulate therein. The air will allow the bristles of the paint brush 14 dry quickly after being cleaned and prevent mold and mildew from forming inside the jacket 12.

The protective cover 10 can be preferably be molded such as by injection for example. In this way, the components herein described are integrally formed. While the application has made mention of a preferred use with professional paint brushes, it is conceived that the invention can be employed with various sized brushes, such as artist brushes or the like, wherein the protective cover 10 would be reduced in size to accomplish the intended goal of the invention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A paint brush protective cover for a paint brush having filaments, a collar retaining said filaments and handle, which includes:

a jacket having a hollow interior section, wherein said jacket has a first panel and a second panel removably connectable to said first panel in a manner to be maintained in a predetermined spaced relation to receive the paint brush therebetween, wherein each said panel has an upper end and a lower end and are configured to be complementary connected in a manner with said upper ends adjacent one another and said lower ends adjacent one another, wherein said jacket is of a length greater than a combined length of filaments and at least said collar and said upper ends are configured to retain about said collar and said lower ends are configured to retain about said filaments, and wherein said jacket includes at least one lower opening adjacent a terminal part of said lower ends to readily permit drainage from said jacket by virtue of gravity when upper ends are further displaced from a gravitational surface than said lower ends; and wherein each said panel includes at least one panel opening which extends lengthwise from each said upper end into said lower end terminating at a predetermined distance from a lower end edge and is defined by top edge, bottom edge and side edges, and at least one productivity guide and wear bar which extends transversely through said panel opening and interconnecting said side edges to retain filaments of the brush and serves as a visual productivity guide and wear indicator for filament length.

2. The paint brush protective cover of claim 1, which includes a handle opening formed in an end surface of said jacket adjacent said upper ends of said panels allowing the handle of the paint brush to protrude out of said jacket when stored within said jacket.

3. The paint brush protective cover of claim 1, wherein said first panel includes lateral connecting surfaces configured to be received inside of said lateral connecting surfaces of said second panel.

4. The paint brush protective cover of claim 3, wherein one of said lateral surfaces includes a detent surface to aid in maintaining connection between an opposing lateral surface.

5. The paint brush protective cover of claim 3, which includes a laterally extending tab provided on said upper end of said first panel to aid in separating said panels.

6. The paint brush protective cover of claim 1, which includes a laterally extending tab provided on said first panel to aid in separating said panels.

7. The paint brush protective cover of claim 1, which includes a third joining panel interconnecting said lower ends of said first and second panels by way of a living hinge and which includes said lower opening.

8. The paint brush protective cover of claim 3, wherein each said lateral extending surface extends about part of an edge and a side of each panel to which it connects.

9. The paint brush protective cover of claim 1, wherein said productivity guide and wear bar includes an inwardly extending rib lengthwise thereacross.

10. A paint brush protective cover for a paint brush having filaments, a collar retaining the filaments and handle, which includes:

a jacket having a hollow interior section, wherein said jacket has a first panel having lateral connecting surfaces and a second panel having lateral connecting surfaces configured to receive said lateral connecting surfaces of said first panel in a manner to removably connect said first panel and said second panel in a manner to be maintained in a predetermined spaced relation to receive the paint brush therebetween, wherein each said panel has an upper end and a lower end and are configured to be complementary connected in a manner with said upper ends adjacent one another and said lower ends adjacent one another, wherein said jacket is of a length greater than a combined length of filaments and at least the collar and said upper ends are configured to retain about the collar and said lower ends are configured to retain about the filaments, and wherein said jacket includes at least one lower opening adjacent a terminal part of said lower ends to readily permit drainage from said jacket by virtue of gravity when upper ends are further displaced from a gravitational surface than said lower ends; and wherein each said panel includes at least one panel opening which extends lengthwise from each said upper end into said lower end terminating at a predetermined distance from a lower end edge and is defined by top edge, bottom edge and side edges, and at least one productivity guide and wear bar which extends transversely through said panel opening and interconnecting said side edges to retain filaments of the brush and serves as a visual productivity guide and wear indicator for filament length.

11. The paint brush protective cover of claim 10, which includes a handle opening formed in an end surface of said jacket adjacent said upper ends of said panels allowing the handle of the paint brush to protrude out of said jacket when stored within said jacket.

12. The paint brush protective cover of claim 10, wherein one of said lateral surfaces includes a detent surface to aid in maintaining connection between an opposing lateral surface.

13. The paint brush protective cover of claim 10, which includes a laterally extending tab provided on said upper end of said first panel to aid in separating said panels.

14. The paint brush protective cover of claim 10, which includes a third joining panel interconnecting said lower ends of said first and second panels and which includes said lower opening.

15. The paint brush protective cover of claim 10, wherein each said lateral extending surface extends about part of an edge and a side of each panel to which it connects.

16. The paint brush protective cover of claim 10, wherein said productivity guide and wear bar includes an inwardly extending rib lengthwise thereacross.

* * * * *